US005463988A

United States Patent [19]

Paul

[11] Patent Number: 5,463,988

[45] Date of Patent: Nov. 7, 1995

[54] VALVE ACTUATING MECHANISM FOR AN INTERNAL COMBUSTION ENGINE

[75] Inventor: Michael Paul, Bad Friedrichshall, Germany

[73] Assignee: Audi AG, Ingolstadt, Germany

[21] Appl. No.: 318,757

[22] PCT Filed: Apr. 2, 1993

[86] PCT No.: PCT/EP93/00822

§ 371 Date: Oct. 13, 1994

§ 102(e) Date: Oct. 13, 1994

[87] PCT Pub. No.: WO93/21427

PCT Pub. Date: Oct. 28, 1993

[30] Foreign Application Priority Data

Apr. 16, 1992 [DE] Germany ..... 42 12 844.7

[51] Int. Cl.[6] ..... F01L 1/12; F01L 1/18; F01L 1/26

[52] U.S. Cl. ..... 123/90.16; 123/90.4

[58] Field of Search ..... 123/90.15, 90.16, 123/90.17, 90.22, 90.27, 90.39, 90.4, 90.44

[56] References Cited

U.S. PATENT DOCUMENTS

| | | | |
|---|---|---|---|
| 4,844,023 | 7/1989 | Konno et al. | 123/90.17 |
| 5,042,437 | 8/1991 | Sakuragi et al. | 123/90.16 |
| 5,207,193 | 5/1993 | Sugimoto et al. | 123/90.16 |
| 5,388,552 | 2/1995 | Sugimoto et al. | 123/90.16 |

FOREIGN PATENT DOCUMENTS

| | | |
|---|---|---|
| 0213759 | 3/1987 | European Pat. Off. . |
| 462853 | 12/1991 | European Pat. Off. . |
| 505231 | 9/1992 | European Pat. Off. . |
| 2199894 | 7/1988 | United Kingdom . |

*Primary Examiner*—Henry C. Yuen
*Assistant Examiner*—Weilun Lo
*Attorney, Agent, or Firm*—Lalos & Keegan

[57] ABSTRACT

A valve actuating mechanism for the inlet valves E of a cylinder of an internal combustion engine has a first set of rocker arms 6 each of which actuates an inlet valve E and is actuated by a cam 2, 3, 4 for a lower engine speed range, and a second set of rocker arms 9 which are mounted between a first set of adjacent rocker arms 6 and are actuated by identical cams 8 for the higher engine speed range. The second set of rocker arms 9 is interconnected by means of a crosspiece 10. The first set of rocker arms 6 contains radially movable pistons 12 which in the higher speed range are displaced outward by oil pressure and against which the crosspiece 10 of the second set of rocker arms 9 can rest. Consequently, the valves E are actuated by the second set of rocker arms 9 as determined by the outline of the cams 8.

4 Claims, 2 Drawing Sheets

VALVE ACTUATING MECHANISM FOR AN INTERNAL COMBUSTION ENGINE

The invention relates to a valve actuating mechanism for an internal combustion engine.

BACKGROUND OF THE INVENTION

In a state-of-the-art valve actuating mechanism of this type (EP-A 213 759 or GB-A-2199894) connection between the first and the second set of rocker arms in the higher speed range is effected by means of pistons displaceable by oil pressure which are mounted radially to the swivel axis of the rocker arms in bores provided in the rocker arms. The bores are aligned with each other when the rocker arms rest on the base circles of their cams. In the lower speed range, in which the valves are to be actuated by the cams associated with the first set of rocker arms, the frontal surfaces of the meeting pistons are situated in the division planes between the rocker arms, so that the valves are actuated exclusively by the first set of rocker arms and the second set of rocker arms can swing freely. In the upper speed range the pistons are displaced in such a way that they penetrate the division planes, with the result that the second set of rocker arms is connected to the first set of rocker arms and the valves are actuated by the second set of rocker arms as determined by the outline of the cams associated with the second set of rocker arms. Different valve lifts and different open periods can accordingly be produced in the higher and the lower speed ranges. One disadvantage of the state-of-the-art design is that in the lower speed range the frontal surfaces of the pistons continually slide into each other and that very high precision is required in manufacture of the pistons and the bores.

SUMMARY OF THE INVENTION

It is an object of the invention to create a valve actuating mechanism of the state-of-the-art type in which wear is reduced and the manufacture of which is simplified.

It is proposed on the basis of the invention that the pistons be retained by springs in the lower speed range so that no contact takes place with the second set of rocker arms. Since no bores are provided in the second set of rocker arms that must come into alignment with the bores in the first set of rocker arms if the valves of the first set of rocker arms are to be actuated by the second set of rocker arms, manufacture is significantly simplified. End facing of the bottom of the crosspiece is all that is required.

Because of manufacturing considerations, the bores and the pistons in the first set of rocker arms are preferably circular in cross-section. The end sections of the pistons, which in the higher speed range operate in conjunction with the bottom of the crosspiece, have a plane surface, as a result of which two-dimensional contact between piston and crosspiece is effected and the surface pressure is correspondingly reduced. In order to make certain that the plane surfaces of the end sections are at all times positioned parallel to the bottom of the crosspiece, it is preferable to provide protection against rotation of the piston that can simultaneously limit the outward movement of the piston.

BRIEF DESCRIPTION OF THE DRAWINGS

An example of an embodiment of the invention is described as follows with reference to the drawings, in which.

DETAILED DESCRIPTION

Figure 1:
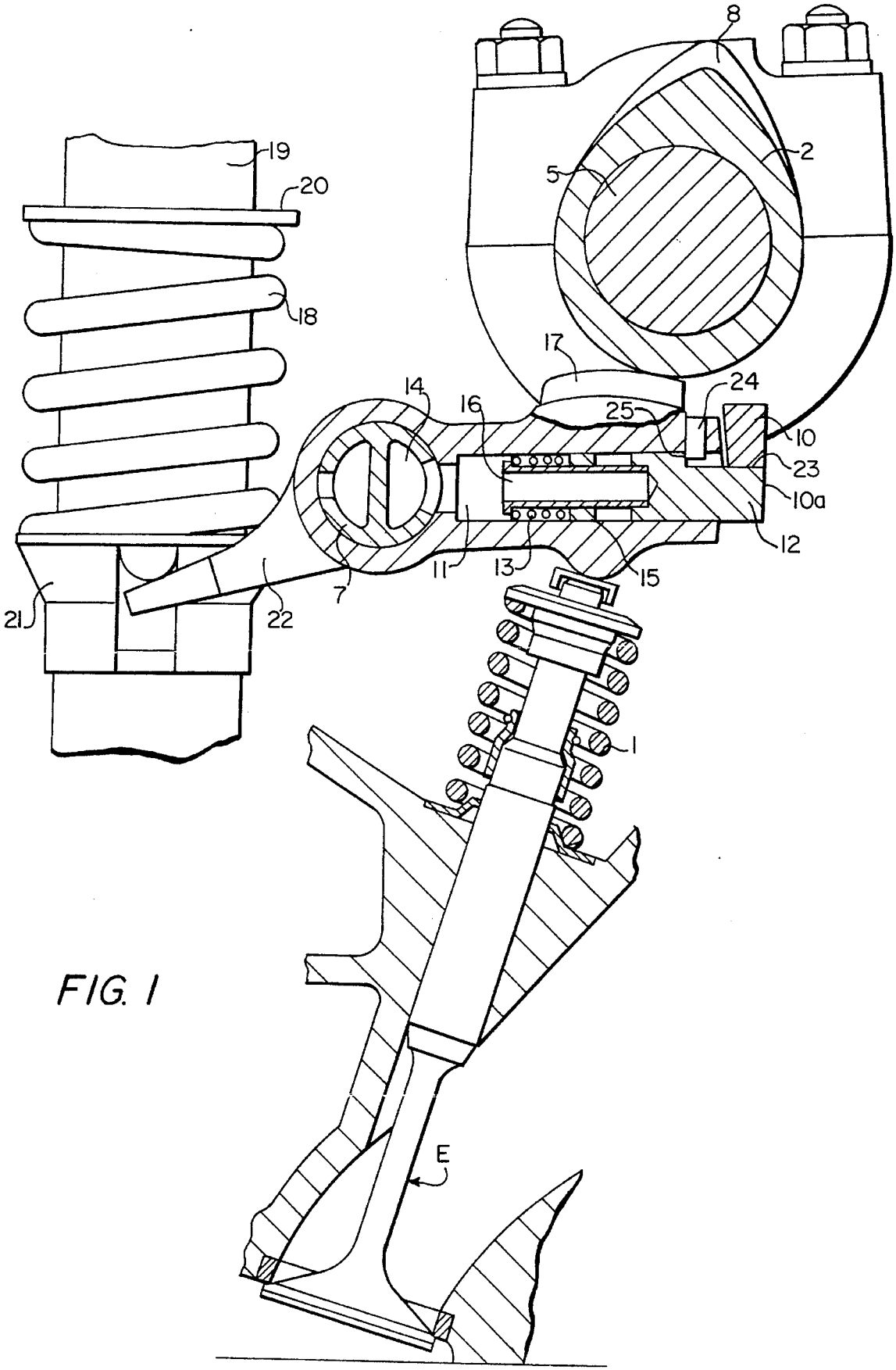
FIG. 1 shows a valve drive with a valve actuating mechanism in accordance with the present invention for three inlet valves, in the vertical section along line 1—1 in FIG. 2.
Figure 2:
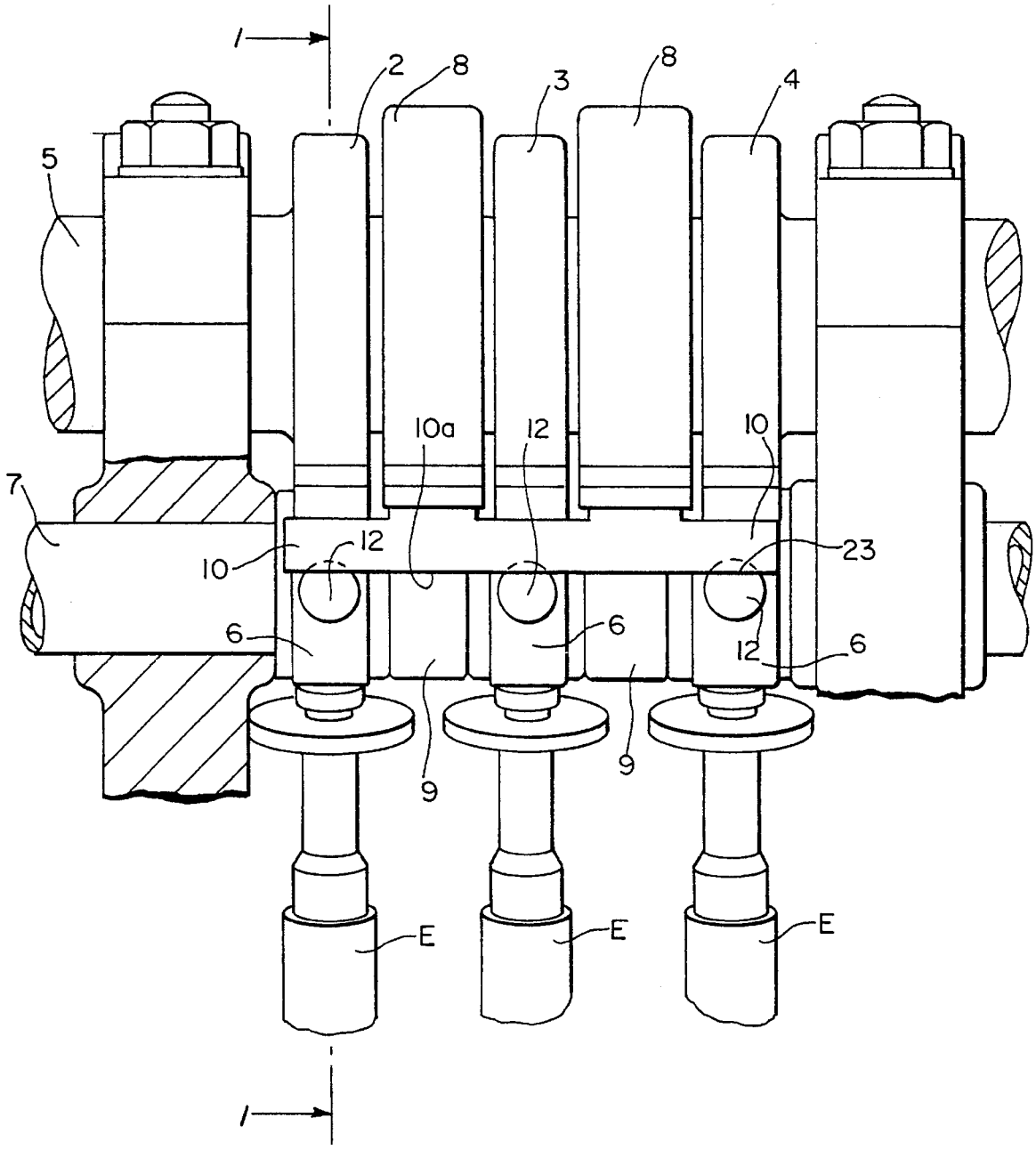
FIG. 2 presents a view in the direction of arrow 2 in FIG. 1.

A valve drive for three inlet valves E is shown in the drawings. A spring 1 applies pressure to each valve E in the direction of closing. The valves are actuated by cams 2, 3, and 4 of a camshaft 5 by way of a first set of rocker arms 6 rotatably mounted on a common stationary shaft 7. The cams 2, 3, and 4 preferably have different cam profiles so as to achieve a different valve lift for the individual inlet valves, a different open period, and/or different control times in order to achieve optimum preliminary conditions in the lower and medium speed ranges of the internal combustion engine. Mounted between adjacent cams 2, 3, 4 on the camshaft 5 is a second set of cams 8 with an identical cam profile designed for the conditions in the higher speed range of the internal combustion engine, and this set accordingly effects, for example, a greater valve lift and a longer open period. Operating in conjunction with the second set of cams 8 is a second set of rocker arms 9 which may be coupled with the first set of rocker arms 6 in the higher speed range, so that in this speed range the valves E are actuated as determined by the profile of the second set of cams 8. The free ends of the second set of rocker arms 9 are connected by a crosspiece 10 that extends to the front of and a short distance from the free end of the first set of rocker arms 6. Radial bores 11 radial to the swivel axis of shaft 7 are provided in the first set of rocker arms 6, in each of such bores 11 a piston 12 is mounted that can be displaced between a first inner position and a second outer position in which the piston projects from its rocker arm 6. In this second position, shown in FIG. 1, the pistons 12 operate in conjunction with the flat bottom 10*a* of the crosspiece 10, so that the second set of rocker arms 9 can actuate the valves E by way of the first set of rocker arms 6 as determined by the outline of the cams 8. Outward displacement of the pistons 12 is effected by oil pressure introduced through a duct 14 in the shaft 7 which communicates with the bores 11. If delivery of the pressure means is interrupted, the pistons 12 are returned to their bores 11 by a spring 13, so that the second set of rocker arms 9 can pivot freely and the valves are actuated by the first set of rocker arms 6 as determined by the outline of the cams 2, 3, or 4. On one side the spring 13 rests on an insert 15 fastened in bore 11 and on the other side the end of a sleeve 16 that is fastened on the piston 12 and extends through the insert 15.

Each rocker arm 6 or 9 has a sliding surface 17 by means of which the rocker arm is applied to its cam 2, 3, 4, or 8. The second set of rocker arms 9 are kept applied at all times to their cams by a spring 18. In the exemplary embodiment the spring is mounted on a spark plug and rests on one side on a stationary spring retainer and on the other on a movable spring retainer 21 that operates in conjunciton with extensions 22 which partly encompass the spark plug dome.

The end sections of the pistons 12 are provided with plane surfaces against which rests the flat bottom 10*a* of the crosspiece 10 when the pistons 12 are in the extended position illustrated. The surface pressure between the crosspiece 10 and the pistons 13 is accordingly reduced. In order to avoid rotation of the pistons 12 and to make certain that the plane surface 23 is at all times parallel to the bottom 10*a* of the crosspiece, protection against rotation is provided in the form of a pin 24 that is inserted into the rocker arms 6 and whose frontal surface rests against the plane surface 23 of the piston. In the extended position the shoulder 25 created by the plane surface 23 rests against the pin 24, as a result of which the outward movement of the piston 12 is limited.

I claim:

1. A valve actuating mechanism for an internal combustion engine including:

at least two inlet valves (E) per cylinder;

a first set of rocker arms (6) and a common shaft (7) for rotatively supporting said first set of rocker arms, a camshaft (5) including first cams (2, 3, or 4) and wherein each of said rocker arms of said first set operates in conjunction with an inlet valve and a first cam for a first engine speed range;

a second set of rocker arms (9) each of which is mounted between two adjacent rocker arms of said first set (6), said common shaft (7) rotatively supporting said rocker arms of said second set, second cams (8), and wherein each of said rocker arms of said second set operates in conjunction with said second cams for a second engine speed range;

a spring (18) for maintaining said second set of rocker arms against said second cams (8);

pistons (12) for coupling said first set of rocker arms to said second set of rocker arms in said second engine speed range;

said first set of rocker arms including a plurality of bores (11) for accommodating said pistons, said bores extending radially to said common shaft and said pistons being movable outward in said bores by oil pressure, and springs (13) for opposing said outward movement of said pistons;

said second set of rocker arms including free ends, and a crosspiece (10) for connecting together said free ends, said first set of rocker arms including free ends and said crosspiece being positioned in front of said first rocker arm free ends; and said crosspiece including a flat bottom (10*a*) for cooperating with said pistons when said pistons are displaced outward.

2. A valve actuating mechanism as in claim 1 wherein said pistons have a circular cross section and include ends provided with a plane surface (23) for cooperation with said crosspiece flat bottom when said pistons are displaced outward.

3. A valve actuating mechanism as in claim 2 including means for preventing rotation and limiting outward movement of said pistons.

4. A valve actuating mechanism as in one of claims 1, 2, or 3 wherein said common shaft includes an oil delivery duct (14) in communication with said bores (11) of said first set of rocker arms.

* * * * *